United States Patent [19]

Garcia

[11] 4,066,532

[45] Jan. 3, 1978

[54] PROCESS FOR PRODUCING PREMIUM COKE AND AROMATIC RESIDUES FOR THE MANUFACTURE OF CARBON BLACK

[75] Inventor: Roberto Garcia, Rio de Janeiro, Brazil

[73] Assignee: Petroleo Brasileiro S.A. Petrobras, Rio de Janeiro, Brazil

[21] Appl. No.: 647,673

[22] Filed: Jan. 9, 1976

[30] Foreign Application Priority Data

June 30, 1975 Brazil ..... 7504079

[51] Int. Cl.[2] ..... C10G 9/14

[52] U.S. Cl. ..... 208/131; 208/50

[58] Field of Search ..... 208/46, 131, 50, 106

[56] References Cited

U.S. PATENT DOCUMENTS

| | | | |
|---|---|---|---|
| 3,617,515 | 11/1971 | Bloomer | 208/131 |
| 3,704,224 | 11/1972 | Scovill et al. | 208/131 |
| 3,759,822 | 9/1973 | Folkins | 208/131 |
| 3,930,985 | 1/1976 | Schieber et al. | 208/131 |

*Primary Examiner*—Herbert Levine

*Attorney, Agent, or Firm*—Sughrue, Rothwell, Mion, Zinn and Macpeak

[57] ABSTRACT

The present invention refers to an integrated process for the delayed coking of mixtures of cracking unit residues and coal tar so as to obtain premium coke and a raw material suitable for the manufacture of carbon black. In view of the composition of the initial feed charge for coking, it is possible to use cracking unit residues which have a sulphur content greater than 3% by weight as well as low aromaticity without said compound charge failing to meet the specifications laid down for the obtention of premium coke and carbon black feedstock.

3 Claims, 1 Drawing Figure

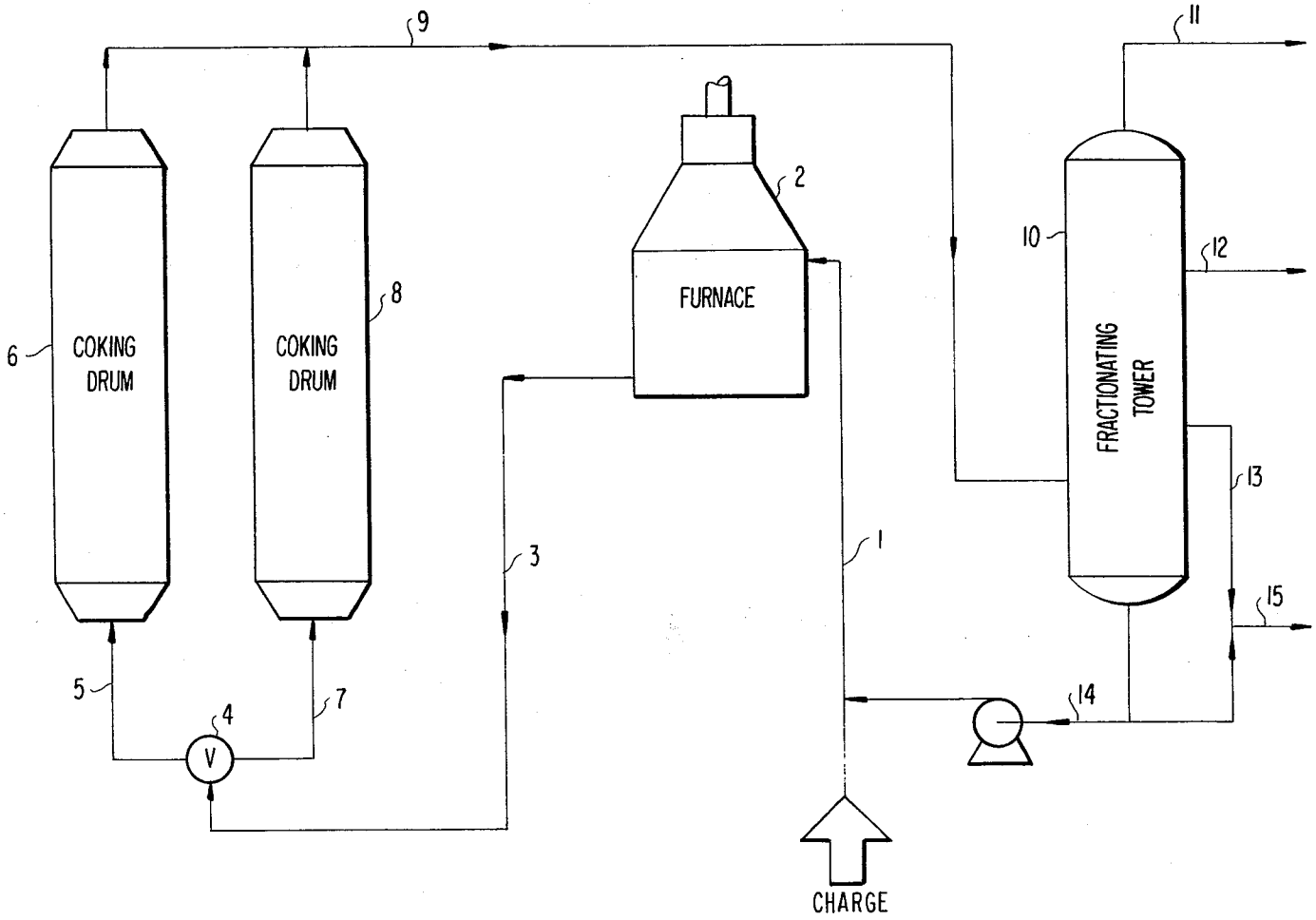
FRACTIONATING TOWER
FURNACE
COKING DRUM
COKING DRUM
CHARGE
V
1
2
3
4
5
6
7
8
9
10
11
12
13
14
15

PROCESS FOR PRODUCING PREMIUM COKE AND AROMATIC RESIDUES FOR THE MANUFACTURE OF CARBON BLACK

The present invention refers to an integrated process for obtaining coke and starting material for the manufacture of carbon black.

More specifically the present invention refers to a process for coking mixtures of cracking unit residue and coal tar so as to simultaneously obtain high yield, high quality coke and starting material suitable for manufacturing carbon black.

The carbon black industry throughout the world has been encountering certain difficulty in obtaining supplies of adequate starting materials in sufficient quantities to attend to the increasing demand for the product. Carbon black was formerly produced from natural gas but the development of the petro-chemical industry enlarged the consumer field for the gas as raw material for other purposes, this having resulted in its price being increased sufficiently to make it uneconomical for use in the production of carbon black. Carbon black for the main part of the world market is now produced by the furnace process using highly aromatic residue as raw material. Such residue, however, must have special characteristics which are difficult to obtain and are not commonly found in present refinery residues. Amongst the most usually used starting material there is a mixture of decanted oil and heavy cycle oil, both these fractions having a high boiling point and being obtained from catalytic cracking units.

Starting materials for producing carbon black must have a certain degree of aromaticity apart from low ash and asphaltene content. The aromaticity indicator index commonly used in gas oils for carbon black starting material is the U.S. Bureau of Mines Correlation Index defined as:

$$\text{BMCI} = 100\,\frac{876}{(\text{temp. of distillation for 50\% at } ^\circ\text{F} + 460^\circ\text{F})} + \frac{670}{131{,}5 + {}^\circ\text{API}} - 4{,}568$$

In practice a BMCI of 100 or more has been considered as an acceptable value for the starting material commonly used by carbon black manufacturers. However, this is not an absolute criterion since the accepted value varies with the availability of raw materials.

Generally speaking, those fractions for producing starting materials for the manufacture of carbon black, such as those already mentioned, do not have the desired aromaticity for which reason it is common practice in many instances to submit said fractions to an extraction treatment with furfural, phenol, or any other suitable solvent with a view to increasing the aromatic content of the starting material. Another disadvantage of this type of starting material is the high sulphur content which must also be reduced in virtue of the maximum sulphur specification for carbon black starting materials.

It is generally known that highly aromatic residues are ideal for the production of carbon black and it is also known that it is possible to concentrate the aromatic content to a maximum by exhaustive extractions. This solution however makes the process extremely expensive and is not industrially advisable.

With a view to obtaining coke by the delayed coking process, use has been made principally of vacuum distillation residues, reduced raw material, decanted oil from catalytic cracking units and tar from the thermal cracking of petroleum.

The quality of the coke obtained depends essentially on the feedstock used, the type of process, temperature, pressure and the period of coking.

The starting materials most usually used for coking are atmospheric distillation residues, vacuum distillation residues or cracking residues (commonly known as decanted oils). Distillation residues generally contain a major portion of sulphur and practically all the metals contained in raw petroleum, such impurities being integrated into the asphaltic structures.

The formation of the coke is arrived at by the combination of three factors: (a) precipitation of the asphaltenes, (b) precipitation of the resins, and (c) condensation of the poly-nucleus aromatics. The vacuum residue and the reduced crude predominantly have the first two types of coke forming mechanism. The aromatic oils on the other hand, as well as the decanted oils, the thermal cracking tars and pit coal tars have a formation defined exclusively by the third mechanism. Those cokes whose formation was determined by the first two mechanisms have heterogeneously distributed small pores with very thick walls and have an amorphous structure. Generally speaking they are not suitable for the manufacture of electrodes.

Cracking residues (especially thermally cracking residues), also known as decanted oils due to the fact that they are aromatics, may result in a special coke known as "needle coke" which is preferred for manufacturing electrodes used in electrometallurgy. The above denomination is due to the elongated appearance of the coke particles, this being explained by the orientation of the crystallities during the coking process. Such crystallities in point of fact assume an elongate eliptical form, being connected in series along their major dimensions, this being explained by the existence of a plastic phase during processing which gives rise to such shape due to the upward flow of the gas in the coking process. In view of the high quality of the above mentioned type of coke it is more expensive than sponge coke, for which reason it is commonly known as premium coke.

Recently attepts have been made to use coal tar pitch which is known to produce needle coal due to its typically aromatical composition.

The operating conditions, however, of such attempts require that the coal tar undergoes a previous fractionating since only the heavy cut is identified as pitch. Apart from this, in view of the fact that the coking reaction of pitch is exothermic, special precautions have been taken in the designing and operating in the delayed coking unit. Such an arrangement also results in extremely elevated thermal requirements and the handling of high molecular weight products (for example condensed nucleus hydrocarbons) which are easily condensable and solidifiable and which are problematic in the handling of the material.

Vacuum residues and reduced raw materials, in their turn, have a serious disadvantage in that they contain metals such as V, Ni, Cu and Fe which are undesirable in the filler, there also being a high content of S (sometimes about 5%) and Silica.

The metals contained in the feed become concentrated in the coke. High metal content cokes are practically useless in the manufacture of electrodes in the aluminium industry since those metals present in the electrodes will be transferred completely to the aluminium during electrolysis. High sulphur content in its turn also makes the coke useless for manufacturing electrodes for aluminium metallurgy since it causes corrosion of the current conductor pins, there being an increase in the electrical resistance in the contact surface and consequently a loss of electrical power.

Tar from the thermal cracking of petroleum is also a suitable feed for delayed coking, but is still problematic in that it has a high S content when arabian type petroleum is being used. Regarding decanted oil when produced by a catalytic cracking process in which a high alumina catalyst is used, its aromatic contents is low and thus the coke formed will not be entirely of the needle type. Decanted oil from a catalytic cracking process using a zeolite catalyst will have a good aromaticity, but since such catalyst has low mechanical strength, the decanted oil will contain a large quantity of catalyst fines, that is to say silicate contamination. In order to eliminate this disadvantage, filtering may be effected before processing a charge. This, however, is a factor which increases the cost of the operation.

An object of the present invention is to obtain a suitable carbon black feedstock, this being achieved by the delayed coking of a feed of which one of the principal constituents is coal tar so that the feed initially submitted to the delayed coking possesses suitable characteristics for the production of premium coke.

Another object of the present invention is to provide a coking feed which, by its very constitution permits one to obtain premium coke whilst at the same time the coking top by-product after removal of its low boiling point constituents, provides a starting material which is perfectly suitable for producing carbon black without the necessity of any solvent extraction treatment or any other type of purification.

Another object of the present invention is to enable one to use high sulphur content (>3%) catalytic cracking residues since the low sulphur content of coal tar compensates the high sulphur content of the cracking residue, forming thereby a feed suitable for producing coke and a starting material for producing carbon black within the required specifications.

Another object of the present invention is to permit one to use decanted oil from catalytic cracking using a high alumina catalyst of heavy fractions obtained from paraffin-based petroleums such as those from Bahia. In the present invention it has been found that the combination of the above mentioned decanted oil with coal tar which by its very nature has a low sulphur content, provides a delayed coking by-product in the form of gas oil having ideal aromaticity conditions for the manufacture of carbon black.

Another object of the present invention is to provide a feed having a low content of undesirable contaminants such as asphaltenes, sulphur, silica and metals as a result of which one is able to produce coke and starting material for carbon black which fully comply with consumer specifications.

The present invention consists in the provision of a feed which may contain from 10 to 100% by weight of coal tar and 90 to 0% of decanted cracking oil, placing said feed in a heating furnace and later in a delayed coking unit where premium coke is formed.

The top product of said coking is delivered to a fractionating column for the withdrawal of gases, gasoline and light gas oil, the heavy gas oil being stored as a raw material for the manufacture of carbon black.

Apart from eliminating certain treatment stages such as extraction by the use of solvents, filtering etc. and permitting one to obtain premium coke and a feed for preparing carbon black in a single process, the present invention also has the remarkable characteristic of optimizing premium coke and carbon black feedstock production.

FIG. 1 is a schematic showing of the processing as will now be described.

The feed is introduced through line 1 to furnace 2 where it is heated to coking temperature, it is then passed through line 3 to a flow separator valve 4 which leads the flow to one of the coking drums 6 or 8 through respective lines 5 or 7. The cracking reaction is effected in the coking drum, coke being deposited in the drum and the non-coked material coming out of the top of the drum, being passed along line 9 to a fractionating tower 10 where it is distilled: naphtha and light gas being withdrawn along line 11, light gas oil along line 12, heavy gas oil along line 13 and the bottom residue along line 14. Such bottom residue is added to the heavy gas oil, it then passing along line 15 to storage as a raw material for producing carbon black. When the coke drum 6 or 8 is about two thirds (in volume) full of coke, the flow through valve 4 is switched to the other coke drum 8 or 6 while the first coke drum 6 or 8 is removed by means already known to those skilled in the art. In such a manner the coke formation is conducted alternately in one drum or the other without interrupting the process.

In the above described process the original feed goes directly to the furnace 2 only once and the final product passes along line 15 directly to the feedstock storage. There is therefore no recycling in the coking operation and this comprises one of the advantages of the present invention since the operation permits optimization in obtaining coke and in particular in obtaining starting material for the production of carbon black without altering the quality of the products.

However, if the optimization of carbon black feedstock production is not considered to be important, a certain amount of re-cycling may be effected during the operation, that is to say, part of the bottom product leaving along line 14 may be introduced once more to the system together with the feed in line 1, by means of a pipe and valve arrangement which is not shown in the drawings. At this point the advantage to be obtained will be the increase in the carbon black feedstock aromaticity although there will be a certain reduction in the yield. However, it permits a considerable flexibility in the flow control of the heavy gas oil and in its aromaticity.

The coking feed comprises mixtures of 10 to 100% of coal tar and 90 to 0% decanted cracking oil so as to maintain the sulphur content of the mixture at values less than 3.5%, the ash content less than 0.15% and the asphaltene content less than 8%. Rigid specifications have not been established for the feed to be used for coking; however, practice has established limits similar to those mentioned above in view of the rigid specifications which exist for the final product, that is to say the coke and the carbon black starting material. In the case of the present invention the above specifications are established since the process will result in two products which must satisfy certain maximum contamination limits. The coking process conditions are those which are normal for delayed coking, that is to say a temperature range of 450° C to 510° C, bearing in mind that the feed entered at a higher temperature at the bottom of the coker and is withdrawn at the top at a temperature about 40° C cooler. The operating pressure is also maintained within the normal range for delayed coking, that is to say between 1.7 and 4 atmospheres.

The distillation range of the first 50% of the coal tar used in the present invention is between 80° and 500° C.

For those versed in the art, but without limiting the present invention, certain examples of applying the new process will now be given.

The four examples to be described refer to the following feeds:

Example 1 — 10% coal tar + 90% decanted cracking oil.

Example 2 — 30% coal tar + 70% decanted cracking oil.

Example 3 — 50% coal tar + 50% decanted cracking oil.

Example 4 — Coal tar.

Table 1

| PROPERTIES | Properties of the feed for coking EXAMPLE 1 | EXAMPLE 2 | EXAMPLE 3 | EXAMPLE 4 |
|---|---|---|---|---|
| Specific Gravity, ° API | 6.1 | 2.5 | 4.1 | — |
| $d_{25/25}$ | — | — | — | 1.2260 |
| Ramsbottom Carbon Residue, weight % | 5.86 | 11.61 | 17.13 | 34.32 |
| Conradson Carbon Residue, weight % | — | 13 | 19 | 29 |
| Sulphur content weight % | 3.5 | 2.56 | 2.29 | 0.71 |
| Asphaltenes, weight % | — | — | — | — |
| Insolubles in normal heptane, weight % | 8.8 | 11.46 | 14.23 | 26.50 |
| Viscosity, cSt | | | | |
| at 37.8° C | 38.5 | 64.62 | 98.30 | 29.70 |
| at 98.9° C | 4.20 | 4.769 | 6.655 | 46.97 |
| Pour Point ° C | — | — | — | — |
| Flash Point, ° C | — | — | — | 74 |
| Ash, weight % | 0.02 | 0.05 | 0.03 | — |
| Water, volume % | 0.5 | 1.3 | 1.9 | 5.0 |
| High Heating Value,cal/g | — | — | — | 8.570 |
| Metals, weight ppm | | | | |
| Na | 2 | 2 | 2 | 2.3 |
| Fe | 22 | 8 | 13 | 23 |
| Ni | 0.2 | 0.3 | 0.4 | 0.6 |
| Cu | — | 0.9 | 0.08 | 0.06 |
| V | <0.1 | <0.1 | <0.1 | <0.2 |
| $SiO_2$,weight ppm | 100 | 81 | 61 | 10 |
| Paraffins (SHELL), weight % | — | — | — | — |
| Aniline point ° C | — | — | — | — |
| Distillation,vol.% | ASTM D-1160 | ASTM D-1160 | ASTM D-1160 | HEMPEL (**) |
| | — | ° C | ° C | ° C |
| I.B.P. | — | 202 | 192 | 84 |
| 5 | 320 | 254 | 250 | 165 |
| 10 | 336 | 316 | 271 | 244 |
| 15 | 348 | 344 | 318 | 254 |
| 20 | 358 | 354 | 339 | 280 |
| 25 | 367 | 364 | 353 | 332 |
| 30 | 374 | 372 | 362 | 360 |
| 35 | 380 | 380 | 371 | 380 |
| 40 | 387 | 386 | 378 | 406 |
| 45 | 393 | 392 | 384 | 434 |
| 50 | 401 | 401 | 394 | 460 |
| 55 | 409 | 407 | 403 | |
| 60 | 415 | 415 | 414 | |
| 65 | 422 | 424 | 428 | |
| 70 | 432 | 432 | 444 | |
| 75 | 441 | 444 | 466 | |
| 80 | 451 | 459 | 497 | |
| 85 | | 476 (83%) | — | |

(**) % in weight × ° C
The following operating conditions were used in the four examples:
Pressure: 45 psig or 3.07 manometric atm.
Temperature at the bottom of the coking drum: 480° C.

Table 2

| PRODUCT | Coking Yield EXAMPLE 1 | EXAMPLE 2 | EXAMPLE 3 | EXAMPLE 4 |
|---|---|---|---|---|
| $H_2S$ | 0.20 | — | 0.20 | 0.20 |
| Fuel Gas | 5.38 | 4.16 | 2.61 | 0.86 |
| LPG | 1.42 | 1.25 | 0.84 | 0.08 |
| Naphtha ($C_5$-200° C) | 5.50 | 4.88 | 3.43 | 2.66 |
| Light Gas Oil (200–345° C) | 22.55 | 23.99 | 28.48 | 29.50 |
| Heavy Gas Oil (345° C-FBE) | 34.55 | 30.77 | 25.49 | 18.68 |
| Coke | 30.40 | 34.95 | 38.95 | 48.02 |

Table 3

| PROPERTIES | UNIT | Properties of the green cokes EXAMPLE 1 | EXAMPLE 2 | EXAMPLE 3 | EXAMPLE 4 |
|---|---|---|---|---|---|
| Bulk density | — | 0.980 | 1.068 | — | 0.714 |
| Moisture | weight % | 0.20 | 0.37 | — | — |
| Volatile material | weight % | 9.90 | 9.13 | 20.62 | 10.82 |
| Ashes | weight % | 0.14 | 0.01 | 0.09 | 0.02 |
| Fixed carbon | weight % | 89.96 | 90.86 | — | 89.16 |
| High Heating Value | cal/g | 8860 | 8088 | 9059 | 8845 |
| Sulphur content | weight % | 3.50 | 2.44 | 1.83 | 0.38 |
| Metals | weight ppm | | | | |

Table 3-continued

| PROPERTIES | UNIT | Properties of the green cokes EXAMPLE 1 | EXAMPLE 2 | EXAMPLE 3 | EXAMPLE 4 |
|---|---|---|---|---|---|
| Na | | 6.0 | 8.4 | 6.5 | 8.6 |
| Fe | | 65 | 54 | 81 | 178 |
| Ni | | 5.0 | 1.1 | 10 | 8.4 |
| Cu | | 0.6 | 2.0 | 2.8 | 7.8 |
| V | | <0.3 | <0.8 | <0.4 | <0.8 |
| Ca | | <0.1 | <1 | 19 | 6.3 |
| Silica | weight ppm | 194 | 456 | — | 68 |

Table 4

| PROPERTIES | UNIT | Properties of the heavy gas oil (feedstock for carbon black) EXAMPLE 1 | EXAMPLE 2 | EXAMPLE 3 | EXAMPLE 4 |
|---|---|---|---|---|---|
| Specific Gravity | ° API | 4.7 | 5.8 | 3.8 | — |
| Specific Gravity at 25/25° C | — | — | — | — | — |
| Specific Gravity at 20/4° C | — | 1.0351 | 1.0268 | 1.0421 | 1.191 |
| Sulphur content, | wt.% | 4.7 | 4.02 | 3.40 | — |
| Ramsbottom carbon residue | wt.% | 0.62 | 1.04 | 1.29 | 3.78 |
| Kinematic viscosity at | | | | | |
| 98.9° C | cSt | 3.102 | 3.093 | 3.592 | 8.664 |
| 37.8° C | cSt | 20.65 | 18.50 | 25.71 | 16.59 |
| Pour Point | ° C | 21.0 | 27 | 30 | — |
| Ash | wt.% | 0.01 | 0.01 | 0.01 | — |
| Insoluble in normal heptane | wt.% | 1.30 | 4.35 | 6.22 | — |
| Flash Point | ° C | — | — | 202 | — |
| Bureau of Mines Correlation Index | — | 111 | 108 | 113 | 183 |
| Insoluble in benzene | wt.% | — | 0.58 | 0.20 | — |

I claim:

1. A process for producing premium coke and aromatic residue for the manufacture of carbon black which comprises using as a feed charge a mixture of 10% to 50% coal tar, said coal tar having the characteristic that the first 50% of its volume boils between 80° C and 500° C, and 90% to 50% decanted thermal or catalytic cracking oil, said mixture containing low Na, Fe, Cu, V and silicate values so that the ash value thereof is less than 0.15% by weight, the sulphur value is less than 3.5% and the asphaltene content is less than 8%; and submitting said charge to heating in a furnace and then leading it to coking drums where it undergoes delayed coking at a temperature between 450° C and 510° C., at a pressure of 1.7 to 4.0 manometric atmospheres, so as to produce premium coke and a top product, and then fractionating said top product to provide a heavy oil having high aromatic values, said heavy oil being useful as a raw material for producing carbon black.

2. A process according to claim 1 wherein decanted oil coming from the cracking of gas oils derived from paraffinic petroleums is used.

3. A process according to claim 1 wherein said heavy oil having high aromatic values useful as a raw material for producing carbon black has a BMCI greater than 100.

* * * * *